US005811707A

United States Patent [19]

Kakehashi et al.

[11] Patent Number: 5,811,707

[45] Date of Patent: Sep. 22, 1998

[54] EFFECT ADDING SYSTEM

[75] Inventors: Ikutaro Kakehashi; Tsuneo Higuchi, both of Osaka, Japan

[73] Assignee: Roland Kabushiki Kaisha, Osaka, Japan

[21] Appl. No.: 469,664

[22] Filed: Jun. 5, 1995

[30] Foreign Application Priority Data

Jun. 24, 1994 [JP] Japan ..... 6-166020

[51] Int. Cl.[6] ..... G10H 1/08; G10H 1/38

[52] U.S. Cl. ..... 84/610; 84/609; 84/626; 84/634

[58] Field of Search ..... 84/610, 611, 612, 84/613, 614, 626, 627, 628, 629, 630, 631, 632, 633, DIG. 4, 609, 634

[56] References Cited

U.S. PATENT DOCUMENTS

| | | | |
|---|---|---|---|
| 4,914,687 | 4/1990 | Maeda | 379/88 |
| 5,131,311 | 7/1992 | Murakami et al. | 84/609 |
| 5,231,671 | 7/1993 | Gibson et al. | 381/49 |
| 5,243,123 | 9/1993 | Chaya | 84/609 |
| 5,428,708 | 6/1995 | Gibson et al. | 395/2.79 |
| 5,430,243 | 7/1995 | Shioda | 84/645 |
| 5,446,238 | 8/1995 | Koyama et al. | 84/669 |
| 5,477,003 | 12/1995 | Muraki et al. | 84/610 |
| 5,506,370 | 4/1996 | Nakai et al. | 84/637 |
| 5,511,053 | 4/1996 | Jae-Chang | 369/54 |
| 5,518,408 | 5/1996 | Kawashima et al. | 434/307 A |

FOREIGN PATENT DOCUMENTS

| | | |
|---|---|---|
| 3268599 | 11/1991 | Japan . |
| 58109792 | 7/1993 | Japan . |
| 63440 | 1/1994 | Japan . |
| 6180587 | 6/1994 | Japan . |

OTHER PUBLICATIONS

Search Report of Corresponding English translation indicating items AE and AF above.

*Primary Examiner*—William M. Shoop, Jr.
*Assistant Examiner*—Marlon T. Fletcher
*Attorney, Agent, or Firm*—Lyon & Lyon LLP

[57] ABSTRACT

An effect adding system for use in Karaoke performance applications is provided which, when one person sings, singing with different height from that of the actual singing, or singing with different timing from that of the actual singing, is automatically carried out to yield, in part, the same effect as if a chorus, duet, round, or the like is performed by a plurality of persons. In one embodiment, the effect adding system accomplishes this by means of pitch conversion and/or delay of the aural input signal in response to pitch conversion and/or delay information deriving from stored performance information for a particular musical composition.

6 Claims, 8 Drawing Sheets

(a)

(b)

EFFECT ADDING SYSTEM

BACKGROUND OF THE INVENTION

1. Field of the Invention

The present invention relates to an effect adding system, and more particularly to an effect adding system which is suitable for use in Karaoke system (singing-accompaniment machine).

2. Description of the Related Art

Recently, the spread of Karaoke machine into cookshops, restaurants, homes and the like are remarkable, so that Karaoke singing to the accompaniment of Karaoke performance by employing a Karaoke machine is enjoyed widely in cookshops, restaurants or homes.

As a Karaoke machine for effecting such Karaoke accompaniment, a system wherein accompaniment sounds have been stored as performance information, and a sound source is driven on the basis of the performance information to reproduce the accompaniment sounds has been known other than a conventional Karaoke machine wherein audio signals of accompaniment sounds have been recorded, and reproduce the same as occasion calls.

In Karaoke systems of the above described type wherein a sound source is driven on the basis of performance information, MIDI (Musical Instrument Digital Interface) specification for hardware (transmitter-receiver circuit). and software (data format) which is established for connecting different musical instruments between them, or connecting automatically performing device, sound source, effect device, computer, lighting control, mixer and the like one another, whereby exchange of information comes to be possible mutually is utilized.

U.S. Pat. No. 5,294,746 discloses a Karaoke machine in which back chorus has been stored in PCM to reproduce the same. In this invention of the U.S. Pat. No. 5,294,746, it has been arranged in such that the back chorus is maintained as a number of patterns, and a pattern which is most suitable as accompaniment is selected and reproduced, or simple PCM has not been utilized, but ADPCM wherein data compression is conducted has been utilized. However, there are still such a problem that an amount of data for performing back chorus becomes extensive, and a disadvantage in that because one of the patterns must be selected from the limited patterns, the optimal chorus cannot be obtained.

OBJECT AND SUMMARY OF THE INVENTION

The present invention has been made in view of such problems involved in the prior art, and an object of the invention is to provide an effect adding system wherein in Karaoke performance application, when one person sings, another singing with a different height in sound from that of the former singing sang by the single person is automatically performed, whereby the same effect as in the case where as if chorus, duet or the like is performed by a plurality of persons, but not single person's singing in reality can be obtained.

Furthermore, another object of the present invention is to provide an effect adding system wherein in Karaoke performance application, when one person sings, another singing with a different timing from that of the former singing sang by the single person is automatically performed, whereby the same effect as in the case where as if round, or back chorus is performed can be obtained.

In order to attain the above described object, the effect adding system according to the present invention comprises an input means for inputting aural signals from the outside; an accompaniment sound producing means for producing accompaniment sounds of a musical composition; a storage means for storing prescribed performance information concerning said musical composition; a pitch conversion information outputting means for outputting the pitch conversion information for pitch conversion based on the prescribed performance information stored in said storage means in synchronous with the accompaniment sounds produced by said accompaniment sound producing means; and a pitch-converting means for converting a pitch of the aural signals inputted from said input means in response to the pitch conversion information output from said pitch conversion information outputting means to output the aural signals of the converted pitch.

Accordingly, the aural signals inputted from the outside through the input means by singing words of a musical composition by a person are pitch-converted on the basis of prescribed performance information for said musical composition, for example, chorus information expressing the chorus to be added to the melody of said musical composition stored in the storage means so as to correspond to the pitch of the chorus expressed by said chorus information. This pitch-conversion is carried out by outputting pitch conversion information from the pitch conversion information outputting means to the pitch-converting means in synchronous with the accompaniment sounds produced by the accompaniment sound producing means.

In this situation, the aural signals inputted to the input means are pitch-converted in synchronous with the production of accompaniment sounds of said musical composition from the accompaniment sound producing means to output the aural signals of the converted pitch, whereby a voice with a different height in sound from that of the aural signals inputted to the input means is sounded in synchronous with the accompaniment sounds, so that the same effect as in the case where chorus is performed is obtained.

Furthermore, the effect adding system according to the present invention comprises also a storage means for storing performance information of a musical composition; an automatic performance means for outputting performance control information effecting production and control of musical sounds on the basis of the performance information stored in said storage means; and a delay means for outputting the aural signals inputted with a delay to set a delay time based on the performance control information output from said automatic performance means; the performance information stored in said storage means containing tempo information expressing a performance tempo of the musical composition, whereby the delay time of said delay means is set on the basis of the performance control information corresponding to said tempo information and output from said automatic performance means.

Accordingly, the aural signals inputted are output with a delay by such a delay time which was set by the delay means on the basis of the performance control information corresponding to tempo information, whereby the same effect as in the case where as if round is performed or the same effect as in the case where as if singing of melody and back chorus which follows the melody is performed can be obtained by both of the aural signals inputted which have not been delayed and which have been delayed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the effect adding system according to the present invention will be described in detail hereinbelow in conjunction with the accompanying drawings. It is to be noted that in the following description as to the embodiments, the effect adding system utilizes MIDI signal being event information to control respective devices and apparatuses.

Figure 1:
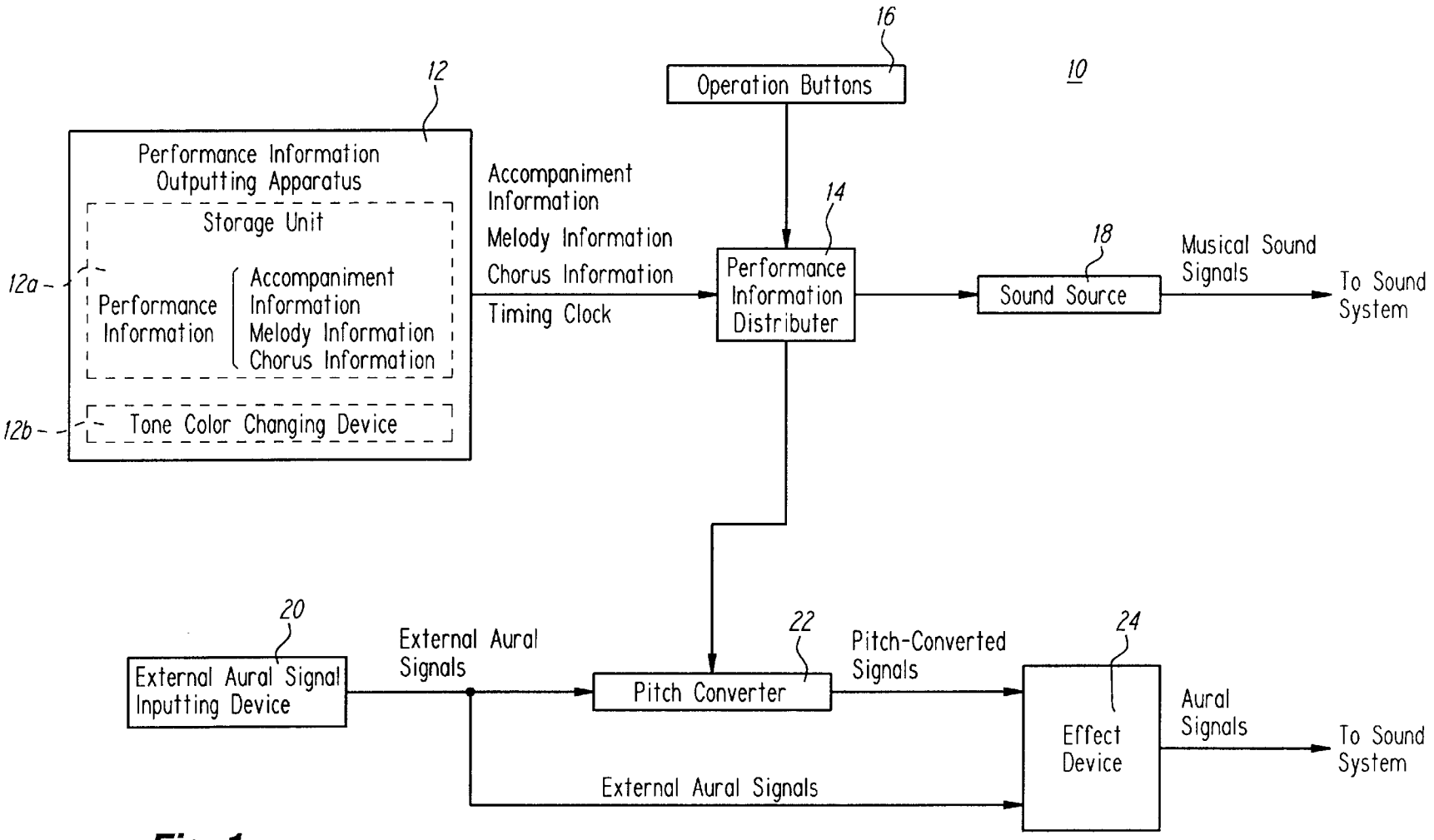
FIG. 1 is a block constitutional diagram showing a constitution of the effect adding system according to the first embodiment of the present invention.

FIG. 1 is a block constitutional diagram showing a constitution of the effect adding system according to the first embodiment of the present invention. The whole operations of the effect adding system are controlled by means of a microcomputer, so that the system may be used, as a matter of course, for Karaoke performance, besides the effect adding system can be used also for the systems other than that of Karaoke performance such as background music (BGM) performance and the like.

This effect adding system 10 comprises a performance information outputting apparatus 12 for outputting musical performance information for the use of performance in Karaoke and BGM; a performance information distributor 14 for distributing the performance information output from the performance information outputting apparatus 12; operation buttons 16 for providing instructions to the performance information distributor 14; a sound source 18 for generating musical sound signals based on the performance information distributed from the performance information distributor 14; an external aural signal inputting device 20 for inputting singing for Karaoke performance being an external voice to convert the same into electrical aural signals; a pitch converter 22 for converting pitches of the external aural signals output from the external aural signal inputting device 20; and effect device 24 for affording prescribed effects to the external aural signals output from the external aural signal inputting device 20 and the pitch-converted signals which are obtained by pitch-converting the external aural signals by means of the pitch converter 22. The musical sound signals output from the sound source 18 and the aural signals output from the effect device 24 (the external aural signals and the pitch-converted signals which passed through the effect device 24) are sounded into a space through a sound system comprising a D/A converter, an amplifier, loudspeakers and the like, whereby Karaoke singing or BGM performance is carried out with Karaoke accompaniment.

The performance information outputting apparatus 12 is provided with a storage unit 12*a* composed of RAM and the like, and this storage unit 12*a* stores, as performance information, accompaniment information, melodic information and chorus information wherein the accompaniment information means the performance information as to accompaniment sound other than melodies of musical compositions which corresponds to performance information of the accompaniment part in Karaoke performance, further the melodic information means performance information as to melody of a musical composition which corresponds to performance information of the singing part in Karaoke performance, and moreover the chorus information means performance information as to chorus to be added to melody of a musical composition which corresponds to the chorus part other than the melodic information in Karaoke performance.

The performance information outputting apparatus 12 reads out the performance information (accompaniment information, melodic information and chorus information) at a prescribed timing to output the information read out together with timing clock to the performance information distributor 14. The timing clock is a message defined in MIDI, and such systems connected with each other in accordance with MIDI connection can synchronizes one another by means of the messages transmitted at a rate of twenty-four per a quarter note.

Furthermore, the performance information outputting apparatus 12 is provided with a tone color changing device 12*b* which can function to change tone colors of the melodic sounds produced on the basis of melodic information in the sound source 18 and chorus sounds produced on the basis of chorus information dependent upon the case where the effect adding system 10 is used for either Karaoke performance or BGM and the like performance other than Karaoke performance.

Generally, in Karaoke performance to assist beginners who are unfamiliar with Karaoke machine so that they are difficult to find a timing of starting a song or pick up a musical interval, the machine is arranged in such that melodic sounds or chorus sounds for guiding singing are output together with accompaniment sounds wherein such melodic sounds or chorus sounds are called by the name of guide tone. Since such guide tone is for assisting beginners, it is required that the guide tone is not so remarkable during Karaoke accompaniment.

On the other hand, it is necessary for informing clearly melodic sounds or chorus sounds in BGM.

For this reason, the effect adding system 10 contains the tone color changing device 12*b* which can be adapted to suitably change tone colors dependent upon whether the use of melodic sounds or chorus sounds is for BGM or not but guide tone by switching a tone color switch or the like (not shown) mounted on the tone color changing device 12*b*.

Furthermore, the effect adding system 10 is constituted in such that when tone colors of melodic sounds or chorus sounds are switched over dependent upon either BGM use or guide tone use in the tone color changing device 12*b,* its sound volume also changes automatically. More specifically, the sound volume of melodic sounds or chorus sounds is arranged so as to be smaller in case of guide tone use than BGM use.

Concerning a technique for changing suitably tone color and sound volume dependent upon whether melodic sounds and chorus sounds are used as BGM performance or not but guide tone purpose as described above, it is sufficient to utilize the technique as disclosed in Japanese Patent Laid-open No. 333890/1993 which has been filed by the present applicant.

More specifically, the Karaoke system disclosed in the above Patent Laid-open No. 333890/1993 is the one which reads out Karaoke data to sound Karaoke accompaniment sounds into a space comprising a Karaoke data read-out means for reading out Karaoke data and which involves a guide tone part performing melodies with instrumental sounds; a musical sound producing means for producing musical sounds on the basis of the Karaoke data read out by the Karaoke data read-out means; a changed data output means outputting the changed data for changing at least either of the tone volume and tone color in said guide tone part; and a change control means for controlling said musical sound producing means on the basis of the changed data output from said changed data output means to change at least either of the tone volume and tone color in the guide tone part which are produced by means of said musical sound producing means. In this constitution, the changed data output means outputs the changed data for changing either one or both of the tone volume and tone color in the guide tone part to the change control means. The change control means controls the musical sound producing means on the basis of the changed data and changes either or both of the tone volume and tone color of musical sounds as to the guide tone part in the musical sounds produced by the musical sound producing means based on Karaoke data. As a result, the musical sound producing means produces such musical sounds in which either or both of the tone volume and tone color recorded in Karaoke data in the guide tone part is (are) different, whereby it is possible to perform the guide tone part being different from Karaoke accompaniment. The guide tone part thus performed is such a part in which melodies are performed with instrumental sounds in order to assist Karaoke singing by a singer. Accordingly, when such guide tone part in which tone volume and tone color are different from those of Karaoke accompaniment is performed, a musical composition with melody which involves different sensation in hearing from that of Karaoke accompaniment can be performed so that such performance of the musical composition may be used for BGM purpose.

While the Karaoke system disclosed in Patent Laid-open No. 333890/1993 is constituted in such that the change control means controls directly the musical sound producing means on the basis of changed data to change tone volume and tone color, the same effect is obtained by the embodiment according to the invention of the present application in only such an arrangement the changed data converted by the tone color changing device 12*b* is supplied to the sound source 18 so as to output as MIDI signal.

The performance information distributor 14 distributes suitably the performance information (accompaniment information, melody information and chorus information) output from the performance information outputting apparatus 12 to the sound source 18 and the pitch converter 22 positioned at the downstream of the performance information distributor 14. The distribution of performance information is effected in response to modes established by an operation of the operation buttons 16. As the modes established by the operation buttons 16, there are "normal mode" and "melody correction mode"

In the case when the normal mode is selected by the operation buttons 16, accompaniment information, melody information and chorus information are distributed to the sound source 18, while chorus information and timing clock signals are distributed to the pitch converter 22.

On the other hand, when the melody correction mode is selected by the operation buttons 16, accompaniment information, melody information and chorus information are distributed to the sound source 18, while melody information and timing clock signals are distributed to the pitch converter 22.

As described above, it becomes possible to selectively distribute melody information or chorus information to the pitch converter 22 by switching over the normal mode and the melody correction mode.

To the sound source 18 is inputted the performance information (accompaniment information, melody information and chorus information) distributed by the performance information distributor 14 to produce musical sound signals in response to the performance information. More specifically, the sound source 18 produces musical sound signals of accompaniment sounds for Karaoke play, musical sound signals of melody sounds, and musical sound signals of chorus sounds, respectively, on the basis of the accompaniment information, the melody information and the chorus information being supplied respectively to the sound source 18.

With respect to production of musical sound signals of melody sounds and chorus sounds, when tone color information or sound volume information is changed by the tone color changing device 12*b* of the performance information outputting apparatus 12, the musical sound signals are produced in accordance with such performance information containing the tone color information and the sound volume information thus changed. In other words, the sound source 18 produces musical sounds in accordance with the performance information which was changed by means of the tone color changing device 12*b* with respect to melody sounds and chorus sounds, that is, the sound source 18 comes to produce such musical sounds being different in the tone color and the sound volume in either the case is for Karaoke performance or BGM performance.

The pitch converter 22 converts the pitch of external aural signals such as the Karaoke singing and the like inputted from the external aural signal inputting device 20 being a microphone or the like into the same pitch with that indicated by the chorus information or the melody information supplied from the performance information distributor 14. Accordingly, in the case where normal mode is selected by the operation buttons 16, the pitch of the external aural signals inputted from the external aural signal inputting device 20 is converted by the pitch converter 22 into the same pitch with that of the chorus information supplied from the performance information distributor 14, whereby a voice having the same height in sound (pitch) in chorus part can be sounded on the basis of the external aural signals inputted.

Furthermore, in the case where the melody correction mode is selected by the operation buttons 16, the pitch of the external aural signal inputted from the external aural signal inputting device 20 is converted into the same pitch with that of the melody information supplied from the performance information distributor 14, whereby it becomes possible to correct the musical interval of the external aural signal inputted to the exactly correct interval indicated by the melody information.

Accordingly, in the case where the effect adding system 10 is used by one who cannot sing at correct musical interval (so-called tone-deaf person), it is sufficient to select the melody correction mode by the operation buttons 16. As a result, melody information comes to be supplied to the pitch converter 22 so that the pitch of the external aural signal inputted to the pitch converter 22 is converted into the same pitch with that indicated by the melody information, whereby such singing being out of the musical interval can be corrected to the accurate interval.

It is to be noted that the technique for pitch conversion effected in the pitch converter 22 is well known, and a variety of techniques have been proposed as described hereinbelow, so that these techniques may be suitably selected and used.

For instance, as disclosed in Japanese Patent Laid-open No. 174096/1988 which has been filed by the present applicant, it is sufficient to arrange in such that the pitch of audio frequency signals (external aural signals) inputted is detected, a computation is performed on the pitch detected and scale signals (melody information or chorus information) supplied separately, whereby the pitch of the audio frequency signals (external aural signals) is converted into that of the scale signals (melody information or chorus information).

Moreover, in the case where the pitch of the aural signals inputted is changed into a prescribed pitch, the technique as disclosed in Japanese Patent Laid-open No. 65098/1987 may also be used. This disclosed technique relates to such a manner that phonemes of the external aural signals inputted are cut out, and the phonemes are adapted to repeat with a desired pitch to convert only the pitch into such desired pitch while maintaining the characteristic frequency region of the voice inputted as it is.

As another technique for pitch conversion as those described above, for example, such a technique wherein when chorus information is stored, a variation from melody information has been stored, and the pitch of the external aural signal inputted is subjected to pitch-conversion by an amount of the chorus information may be applied. More specifically, such information which indicates how much the pitch of the external aural signals inputted is to be changed is given as chorus information in the above described technique. When constituted as described above, there is no need of detecting the pitch of the external aural signal inputted, so that the constitution therefor can be made simple. In this case, however, when the external aural signal inputted is not in a correct musical interval of a musical composition, the voice in chorus which is subjected to pitch-conversion based on chorus information to be sounded becomes also out of the correct musical interval of the musical composition. In addition, the sound source 18 cannot come to perform based on such chorus information as described above without any modification, and hence in this connection, it is required to store such chorus information to be performed by the sound source 18 in the memory unit 12*a*.

In the case when it is not desired to separately store the chorus information for performance unlike as that described above, it may be constituted in such that melody information being the one for height in sound and chorus information being similarly the one for height in sound are supplied to the pitch converter 22, and a computation of "chorus information-melody information" is performed, whereby pitch-conversion is effected by using the result of computation as a variation of the pitch of the external aural signals inputted. In this case, there is no need of detecting the pitch of the external aural signal inputted, besides chorus information can be used also for performance in the sound source 18 without any modification.

Figure 2:
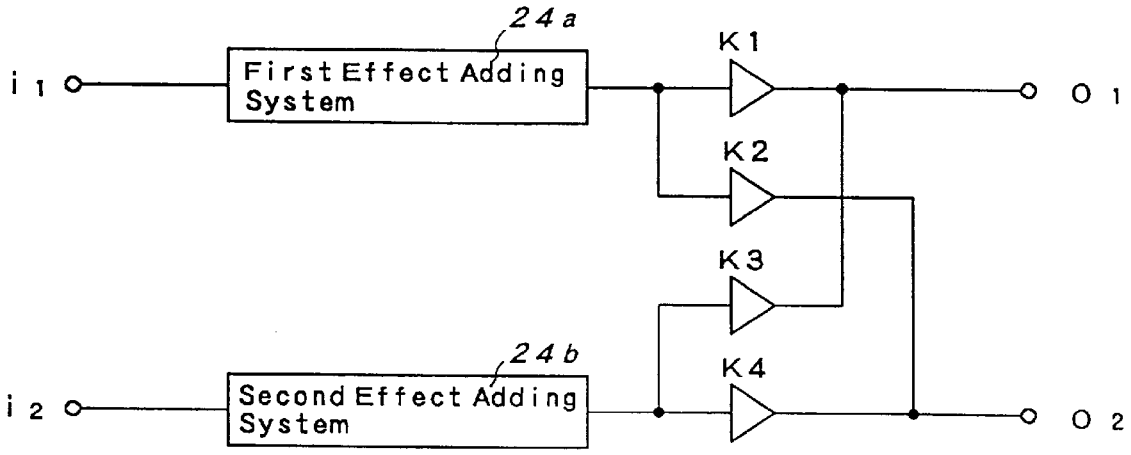
FIG. 2 (*a*) and (*b*) are block constitutional diagrams each showing a constitution of the effect adding system of the present invention.
Figure 2:
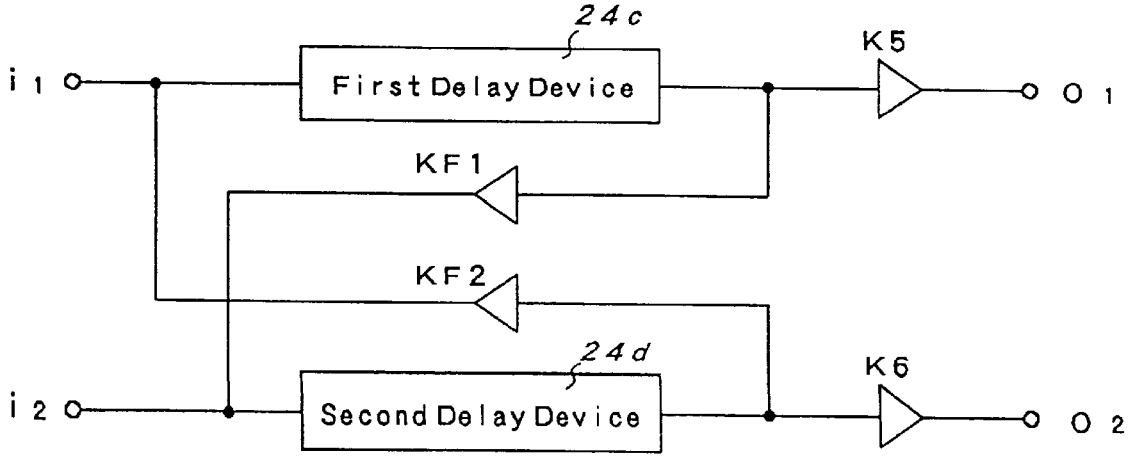

The effect device 24 is the one for suitably affording a variety of effects such as delaying effect, reverbing effect or distortion effect, panning effect or stereophonic effect and the like to the pitch-converted signals output from the pitch converter 22 and external aural signals by operating operation buttons (not shown), and such device may be constituted as shown, for example, in FIGS. 2(*a*) and (*b*). In FIGS. 2(*a*) and (*b*), to an input terminal $i_1$ are inputted pitch-converted signals which has been pitch-converted by the pitch converter 22, while to the other input terminal $i_2$ are directly inputted external aural signals, and the aural signals being the output from the effect device 24 are output from the output terminals $o_1$ and $o_2$ as stereophonic signals.

FIG. 2(*a*) shows an example wherein different effects are added respectively by a first effect adding apparatus 24*a* and a second effect adding apparatus 24*b* which afford effects such as delaying effect, reverbing effect or distortion effect and the like to the pitch-converted signals and the external aural signals which were inputted to the input terminals $i_1$ and $i_2$, respectively. In this case, it may be constituted in such that different effects are not added by the first effect adding apparatus 24*a* and the second effect adding apparatus 24*b*, but a setting (applied) state of such effects comes to be different in both the apparatuses, respectively.

Moreover, in the case of the constitution shown in FIG. 2(*a*), an image normal position of the output signals from the first effect adding apparatus 24*a* can be arbitrarily set by controlling a coefficient to be supplied to multipliers K1 and K2, besides when the above described coefficient is changed sequentially, the image can be transferred into a sound field space so that panning effect can be given. On the other hand, an image normal position of the output signals from the second effect adding apparatus 24*b* can be arbitrarily set by controlling a coefficient to be supplied to multipliers K3 and K4, besides when the above described coefficient is changed sequentially, the image can be transferred into a sound field space so that panning effect can be afforded.

Furthermore, FIG. 2(*b*) shows an example of constitution wherein stereophonically delaying effect is added as an example in which independent effects are not added respectively to the pitch-converted signals and the external aural signals inputted to the input terminals $i_1$ and $i_2$, respectively. More specifically, it is arranged in such that the output of a first delay unit 24*c* is multiplied by a feedback coefficient KF1, the product is inputted to a second delay unit 24*d*, the output of the second delay unit 24*d* is multiplied by a feedback coefficient KF2, and the product is inputted to the first delay unit 24*c*. A multiplier K5 regulates a level of the output signals from the first delay unit 24*c*, while a multiplier K6 regulates a level of the output signals from the second delay unit 24*d*, and when the coefficients of the multipliers K5 and K6 are changed sequentially, a more unique effect can be obtained.

Although a constitution is not particularly shown, it may be modified in such that signals to be inputted to the input terminals $i_1$ and $i_2$ are added one another, and the result is inputted to a common effect adding apparatus.

Furthermore, other modifications may also be made, that is, the effect device 14 is provided with a means for inputting MIDI signals, whereby such MIDI signals which correspond to mode setting of the operation buttons 16 can be output. When the performance information outputting apparatus 12 is made to be capable of storing a setting state of the effect device 14, it becomes also possible to suitably set the effect device 14 by means of the MIDI signals inputted from the outside. In this case, it becomes possible that the effect device 14 is automatically set in cooperation with the operation buttons, or that setting of the effect device 14 is changed with the elapse of time in performance. This arrangement is also applicable for the following other embodiments.

In the constitution as described above, such a case where tone color for Karaoke performance is selected by the tone color changing device 12*b* will be described.

First, when normal mode is selected by operating the operation buttons 16, accompaniment information, melody information, and chorus information are supplied to the sound source 18 by means of the performance information distributor 14, while chorus information and timing clock are supplied to the pitch converter 22.

Then, in the sound source 18 accompaniment musical sound signals for Karaoke performance are produced on the basis of the accompaniment information, melody musical sound signals (guide tone) for Karaoke performance are produced based on the melody information, and chorus musical sound signals (guide tone) are produced on the basis of the chorus information, respectively. Then, these sound signals are output to a sound system to sound a space.

In this case, since tone color for Karaoke performance has been selected by the tone color changing device 12*b*, melody musical sound signals (guide tone) and chorus musical sound signals (guide tone) are produced in accordance with the tone color selected by the tone color changing device 12*b* in the sound source 18 at a small sound volume which is not so marked in accompaniment sounds for Karaoke performance.

On the other hand, the external aural signals derived from the Karaoke singing which was inputted from the external aural signal inputting device 20 is pitch-converted in the pitch converter 22 in synchronous with production of the accompaniment musical sound signals in the sound source 18 and these accompaniment musical sound signals being based on the chorus information and the timing clock supplied from the performance information distributor 14, and the so pitch-converted external aural signals are output to the effect device 24. More specifically, the pitch of the external aural signals is converted into the same pitch with that indicated by the chorus information, and the pitch-converted signals which are obtained by pitch-converting the external aural signals are output to the effect device 24.

Then, the effect device 24 affords effects onto the pitch-converted signals and the external aural signals, and thereafter output the resulting signals to a sound system, whereby Karaoke singing based on the external aural signals and the singing in chorus part based on the pitch-converted signals are sounded into a space.

In accordance with the manner as described above, accompaniment sounds for Karaoke performance, guide tones (melody sounds and chorus sounds), Karaoke singing and singing in chorus part are sounded in a space. In this case, since pitch-conversion for realizing singing in chorus part is carried out on the basis of performance information being event information, specifically MIDI signals, the chorus singing comes to be sounded in synchronous with accompaniment sounds.

Furthermore, when melody correction mode is selected by operating the operation buttons 16, accompaniment information, melody information and chorus information are supplied to the sound source 18, while melody information and timing clock are supplied to the pitch converter 22 by means of the performance information distributor 14, respectively. It is to be noted that actions of the sound source 18 in this melody correction mode are same as those of the above described normal mode, and accordingly the description therefor will be omitted.

In the melody correction mode, pitch-conversion of the external aural signals derived from the Karaoke singing inputted from the external aural signal inputting device 20 is carried out in the pitch converter 22 based on the melody information supplied from the performance information distributor 14 in synchronous with production of the accompaniment musical sound signals in the sound source 18, and then the so pitch-converted signals are output to the effect device 24. In other words, the pitch of the external aural signals is converted into the same pitch as that indicated by melody information, and the pitch-converted signals obtained by pitch-converting the external aural signals are output to the effect device 24.

Values of the respective multipliers are fixed in such that only the pitch-converted signals are output, but external aural signals are not output so that only the singing in the melody part corrected on the basis of the pitch-converted signals is sounded.

Thus, as described above, the accompaniment sounds for Karaoke performance, guide tones (melody sounds and chorus sounds), Karaoke singing and the singing in melody part are sounded in a space. In this case, since the pitch-conversion for realizing the singing in melody part is effected on the basis of performance information (MIDI signals) being event information, melody singing is sounded in synchronous with accompaniment sounds.

Meanwhile, in melody correction mode, the melody singing in accurate musical interval comes to be sounded by means of the pitch-conversion of external aural signal in the pitch converter 22, and accordingly it becomes possible that even a so-called tone-deaf person can sing such Karaoke singing in accurate musical interval for an audience.

Furthermore, in the case where tone color for BGM performance is selected by the tone color changing device 12*b*, accompaniment musical sound signals are produced on the basis of accompaniment information, melody musical sound signals are produced on melody information, and chorus-musical sound signals are produced on the basis of chorus information in the sound source 18, respectively. These musical sound signals are output to a sound system to be sounded in a space. In this case, however, since the tone color for BGM performance has been selected by the tone color changing device 12*b*, when the melody musical sound signals and the chorus musical sound signals are produced in the sound source 18, the sound is produced in a much larger sound volume than that in case of selecting the tone color for Karaoke performance with the tone color selected by the tone color changing device 12*b*.

Figure 3:
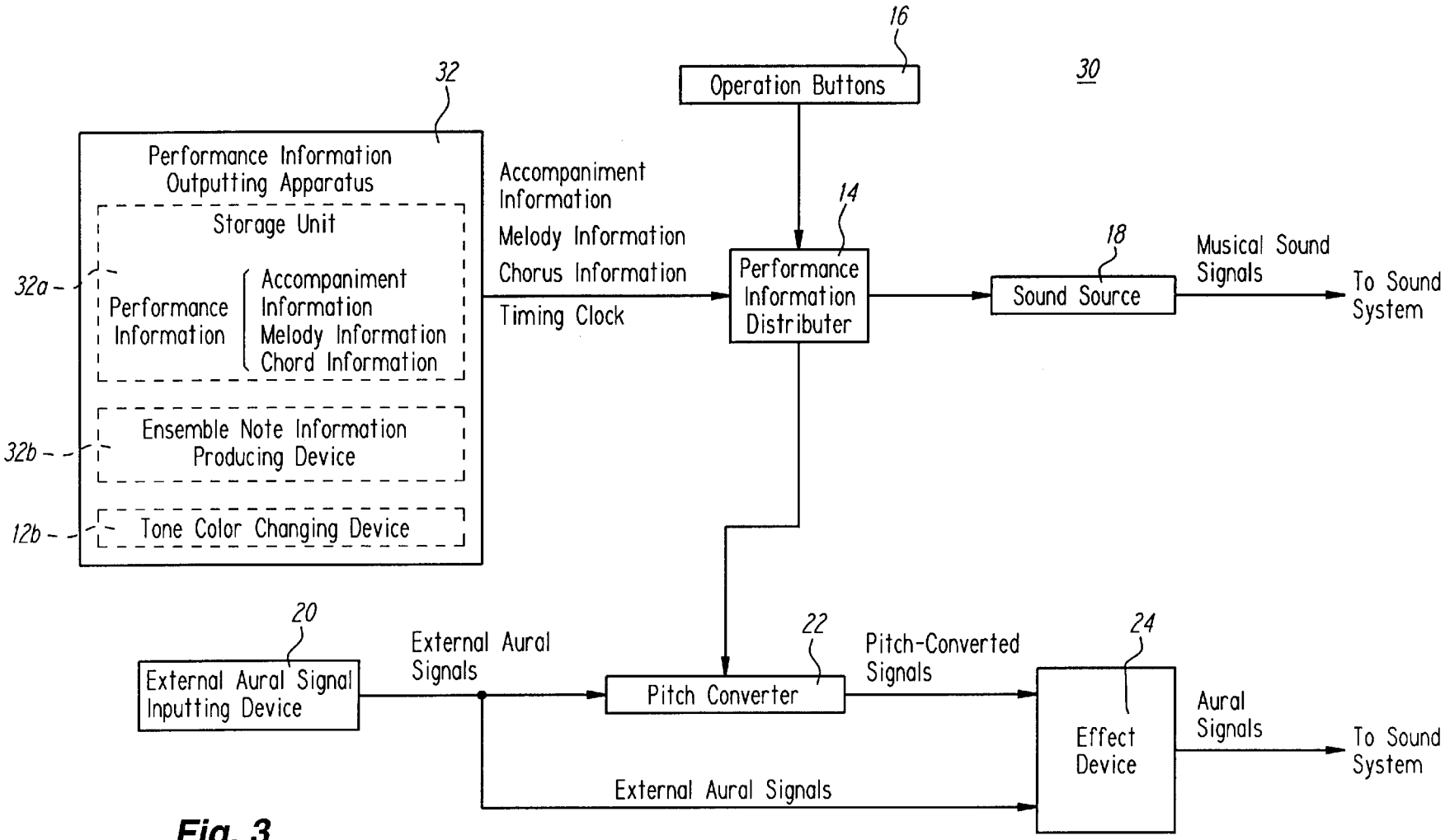
FIG. 3 is a block constitutional diagram showing a constitution of the effect adding system according to the second embodiment of the present invention.

Next, the effect adding system according to the second embodiment of the present invention shown in FIG. 3 will be described hereinbelow. The second embodiment differs from the first embodiment shown in FIG. 1 in only the constitution of the performance information outputting apparatus, so that the detailed constitution and functions thereof will be omitted by illustrating the common constitution with that of the first embodiment by the designation of the same reference characters as those of the former embodiment.

A performance information outputting apparatus 32 in the effect adding system 30 according to the second embodiment is provided with a storage unit 32*b,* ensemble note information producing device 32*b,* and a tone color changing device 12*b.* In the storage unit 32*a,* accompaniment information, melody information and chord information have been stored. Herein, chord information means, for example, the one for expressing chord by root sound and types (major, minor, seventh and the like) of the chord.

The melody information and the chord information stored in the storage unit 32*a* are inputted to the ensemble note information producing device 32*b* to produce ensemble note information therefrom, and the resulting ensemble note is output as chorus information. Accordingly, the performance information output from the performance information outputting apparatus 32 is composed of accompaniment information, melody information and chorus information as same as in the case of the performance information output from the performance information outputting apparatus 12. Moreover, the performance information outputting apparatus 32 outputs also timing clock signals as in the case of the performance information outputting apparatus 12.

As described above, from the performance information outputting apparatus 32 are output accompaniment information, melody information and chorus information, and the information of them are inputted to a performance information distributor 14, so that the treatment of the downstream of the performance information outputting apparatus 32 is the same with that of the above described first embodiment.

In Japanese Patent Laid-open No. 2893/1983 and U.S. Pat. No. 4,429,606 corresponding to the former Japanese Patent application, a technique for realizing the above described ensemble note information producing device 32*b* has been disclosed. More specifically, according to the technique disclosed in the above Patent and the Patent Application, ensemble note tables have been previously prepared in correspondence with various chord, one of the ensemble note tables is selected in response to the accompaniment chord performed by a keyboard, and data for forming ensemble note are read out from the ensemble note table in response to the melody sounds performed by the keyboard, whereby musical sound signals of the ensemble note can be formed on the basis of the data for forming ensemble note. Hence, in the ensemble note information producing device 32*b,* it is sufficient that ensemble note tables have been previously prepared in correspondence with the chord information stored in the storage unit 32*a,* one of the ensemble note tables is selected in response to the chord indicated by the chord information stored in the storage unit 32*a,* and data for forming ensemble note are read out from the ensemble note table as ensemble note information in response to the melody information stored in the storage unit 32*a.*

Figure 4:
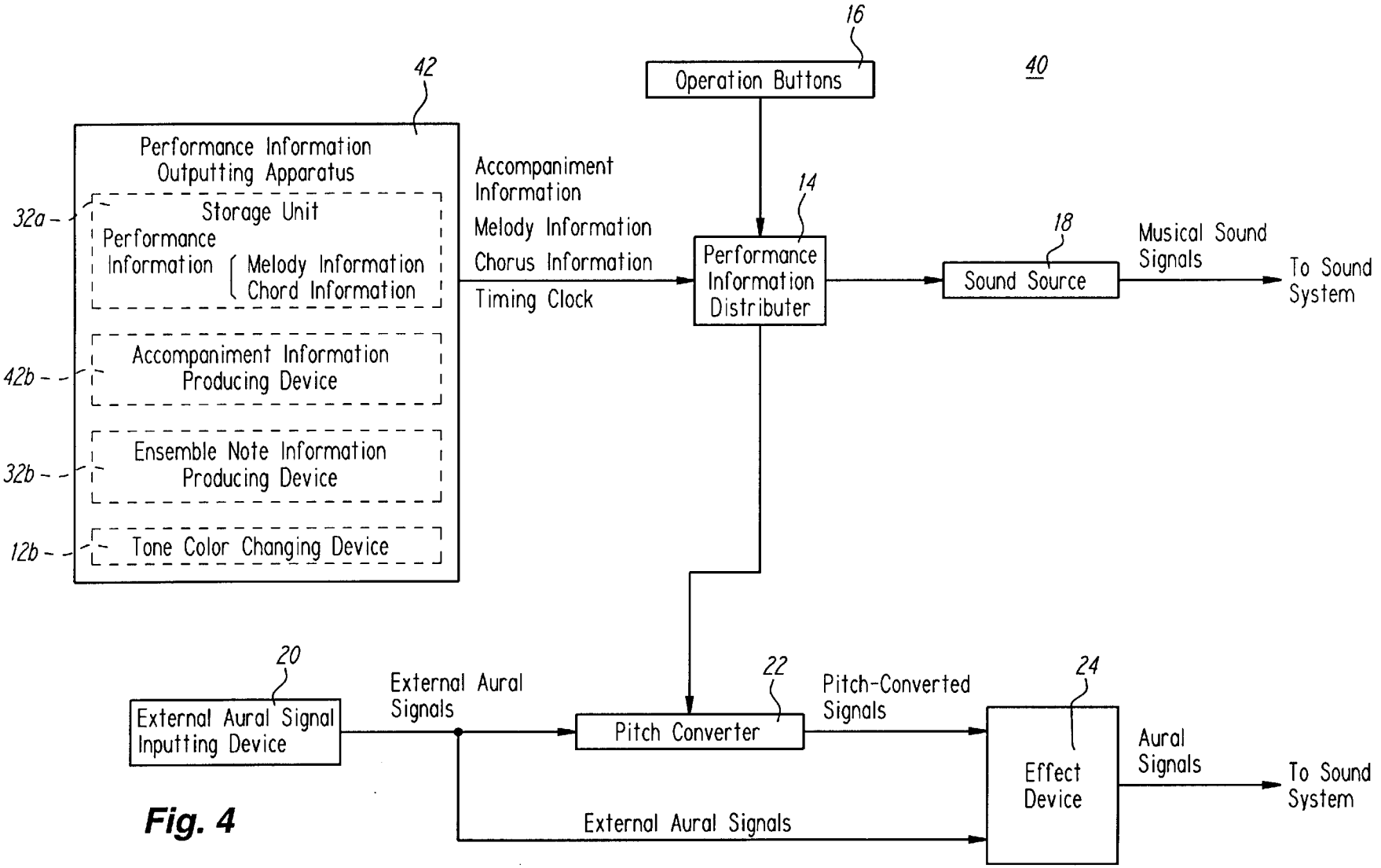
FIG. 4 is a block constitutional diagram showing a constitution of the effect adding system according to the third embodiment of the present invention.

Furthermore, the effect adding system according to the third embodiment of the present invention shown in FIG. 4 will be described hereinbelow. The third embodiment differs from the first embodiment shown in FIG. 1 and the second embodiment shown in FIG. 3 in only the constitution of the performance information outputting apparatus, so that the detailed constitution and functions thereof will be omitted by illustrating the common constitution with those of the first embodiment or the second embodiment by the designation of the same reference characters as those of the former embodiments.

A performance information outputting apparatus 42 in the effect adding system 40 according to the third embodiment is provided with a storage unit 42*a,* an accompaniment information producing device 42*b,* an ensemble note information producing device 32*b* and a tone color changing device 12*b.* In the storage unit 42*a,* melody information and chord information have been stored. Herein, chord information means, for example, the one for expressing chord by root sound and types (major, minor, seventh and the like) of the chord as same as in the case of the second embodiment.

The melody information and the chord information stored in the storage unit 42*a* are inputted to the ensemble note information producing device 32*b* to produce ensemble note information therefrom, and the resulting ensemble note is output as chorus information as in the case of the second embodiment. The accompaniment information producing device 42*b* is a means for inputting chord information to produce accompaniment information therefrom, and outputting the same. Accordingly, the performance information output from the performance information outputting apparatus 42 is composed of accompaniment information, melody information and chorus information as same as in the case of the performance information output from the performance information outputting apparatus 12. Moreover, the performance information outputting apparatus 42 outputs also timing clock signals as in the case of the performance information outputting apparatus 12.

As described above, from the performance information outputting apparatus 42 are output accompaniment information, melody information and chorus information, and the information of them are inputted to a performance information distributor 14, so that the treatment of the downstream of the performance information outputting apparatus 42 is the same with that of the above described first embodiment.

In Japanese Patent Laid-open No. 51815/1979 and U.S. Pat. No. 4,312,257 corresponding to the former Japanese Patent application, a technique for realizing the above described accompaniment information producing device 42*b* has been disclosed. More specifically, according to the technique disclosed in the above Patent and Patent application, plural types of automatic arpeggio patterns and automatic base patterns in correspondence with types of rhythms such as samba, mambo, ballad and the like have been stored in ROM, the automatic arpeggio and automatic base patterns in the types of rhythms selected are read out, and these patterns are changed in response to the root sound of the chord performed by an accompaniment keyboard and types of the chord, whereby automatic arpeggio and automatic base performances corresponding to the chord can be carried out. Since such constitution as described above has heretofore been well known as an automatic accompaniment apparatus, in the accompaniment information producing device 42*b,* it is sufficient that plural types of automatic arpeggio patterns and automatic base patterns in correspondence with types of rhythms such as samba, mambo, ballad and the like have been stored in ROM, the automatic arpeggio and automatic base patterns in the types of rhythms selected are read out, and these patterns are changed in correspondence with the root sound of the chord indicated by the chord information stored in the storage unit 42*a* and types of the chord, whereby automatic arpeggio and automatic base performances corresponding to the chord are effected. Furthermore, it may also be modified in such that as accompaniment pattern, not only one type of automatic arpeggio pattern has been prepared, but also a variety of accompaniment patterns, whereby a suitable pattern can be selected.

In the respective embodiments described above, while such a constitution that the pitch converter 22 is not provided with a delay means for adding a prescribed delay time, it may be, of course, modified in such that the pitch converter 22 is provided with a delay means.

Figure 5:
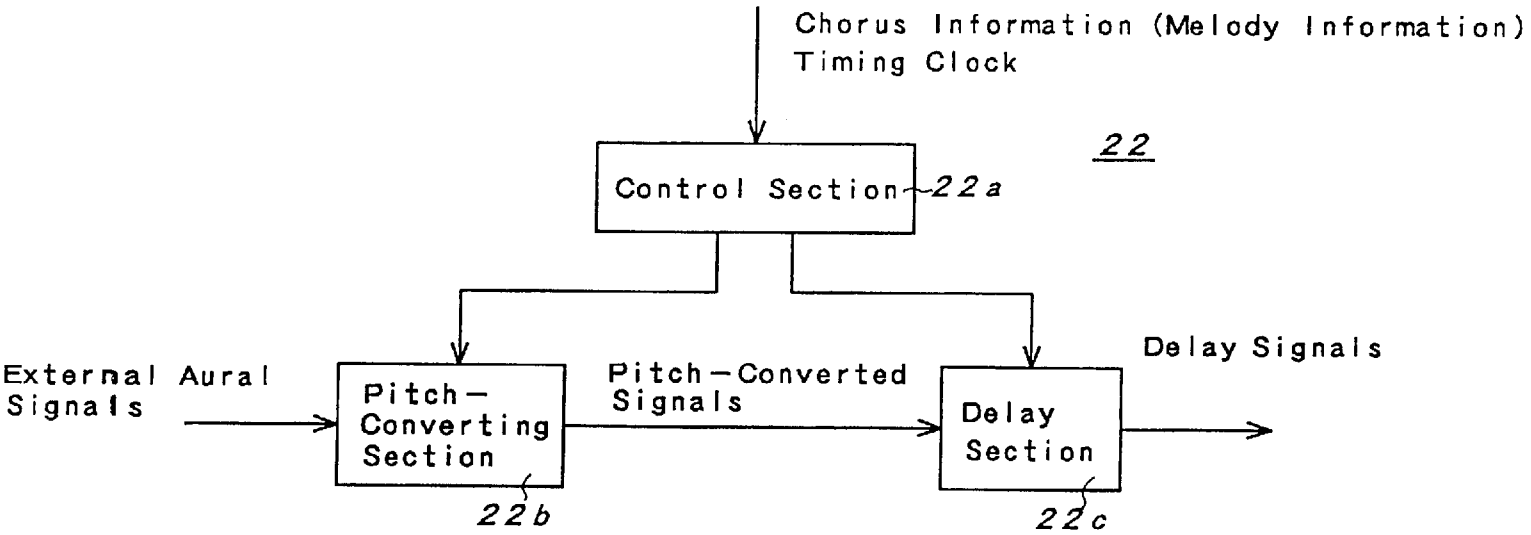
FIG. 5 is a block constitutional diagram showing a constitution of the pitch converter which can afford delay effect according to the present invention.

In FIG. 5, a constitutional example of a pitch converter 22 provided with a delay means wherein the chorus information (melody information) and the timing clock signals supplied from a performance information outputting apparatus 12 are inputted to a control section 22*a,* the information and signals inputted are subjected to data-conversion into suitable data in the control part 22*a,* and the data thus obtained are supplied to a pitch-converting section 22*b* and a delay section 22*c,* respectively. Besides, the control section 22*a* is provided with a setting device (not shown) for setting a delay time of musical expression such as (1/2) beat, 1 beat, (3/2) beat . . . and the like beats.

More specifically, the chorus information (melody information) and timing clock supplied from the performance information outputting apparatus 12 are inputted to the control section 22*a,* a delay amount corresponding to timing clock is set based on the delay time such as (1/2) beat, 1 beat, (3/2) beat and the like beats which have been set in the control section 22*a.* In other words, delay information such as (1/2) beat, 1 beat, (3/2) beat . . . and the like beats produces in the control section 22*a,* and such delay information is supplied to the delay section 22*c.*

It is to be noted that since the delay section 22*c* is disposed only at the latter part of the pitch-converting section 22*b* as a delay section in the pitch converter 22 as shown in FIG. 5, only the external aural signals which have been pitch-converted by passing through the pitch-converting section 22*b* are delayed, while such external aural signals which have not been pitch-converted without passing through the pitch converting section 22*b* are not delayed.

Figure 6:
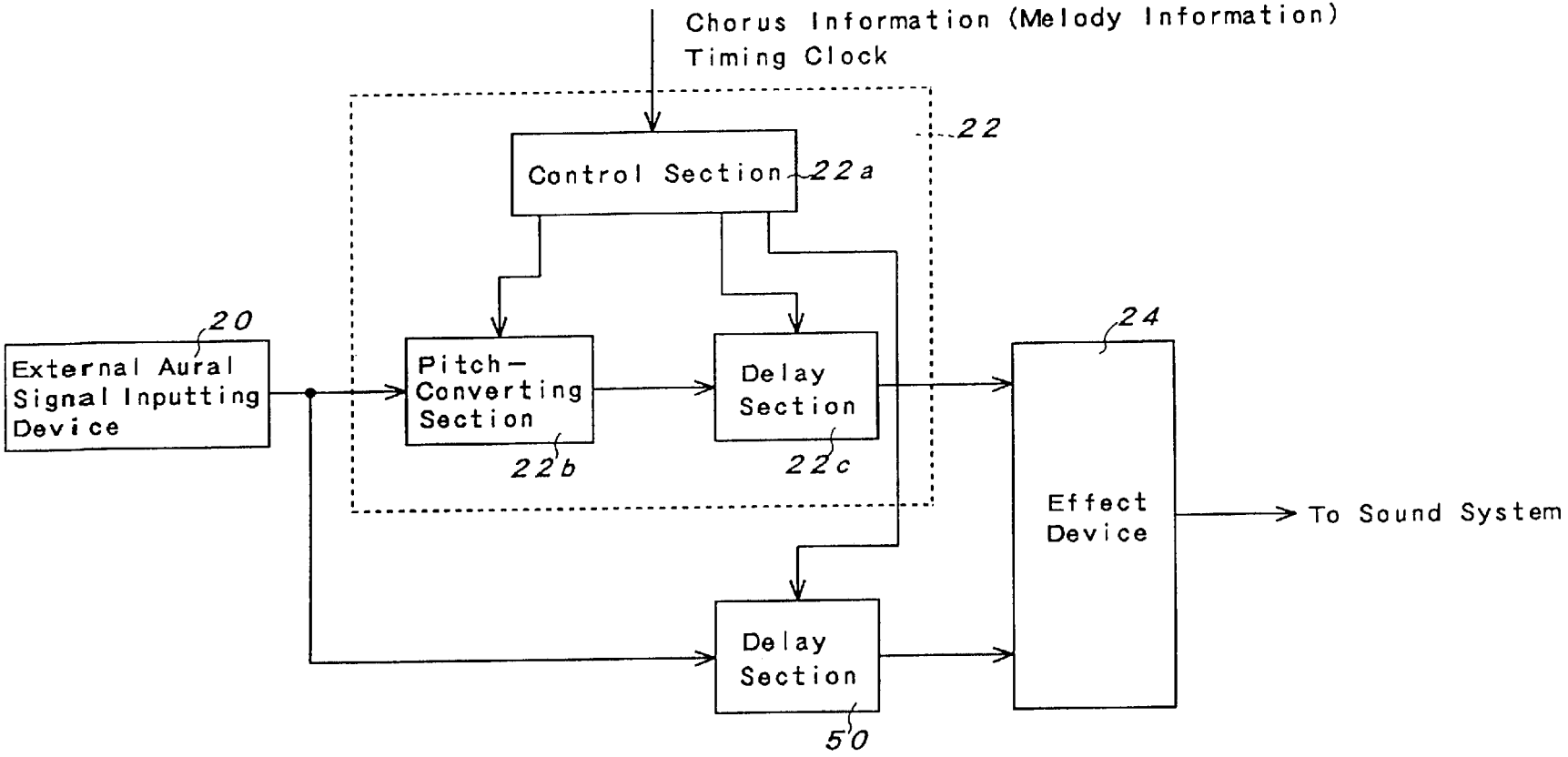
FIG. 6 is a block constitutional diagram showing another constitution of a part which is composed of the external aural signal inputting means, the pitch converter and the effect device in the respective embodiments.

In this respect, however, when a part composed of the external aural signal inputting device 20, the pitch converter 22 and the effect device 24 in the above described respective embodiments is constituted in such that as shown in FIG. 6 and a delay section 50 for inputting such external aural signals which have not been pitch-converted is further disposed, it is possible to delay the external aural signals which have not yet been pitch-converted.

The control device 22*a* shown in FIG. 6 is the one which can set a delay time in the delay sections 22*c* and 50 to a value from "0" to a suitable one, while a delay amount based on timing clock may also be arbitrarily set.

In the case when a voice inputted is intended to delay as to only a specified part in a musical composition, a control signal which turns the delay section 22*c* ON is stored at a position from which a delay starts, while another control signal which turns the delay section 22*c* OFF is stored at a position at which the delay is to be completed in its performance information, respectively, and when such ON- or OFF signal is supplied from the performance information outputting apparatus 12 to the delay section 22*c* based on the information containing these control signals, it becomes possible to delay only a prescribed interval of the musical composition to sing a song in a circular canon.

Figure 7:
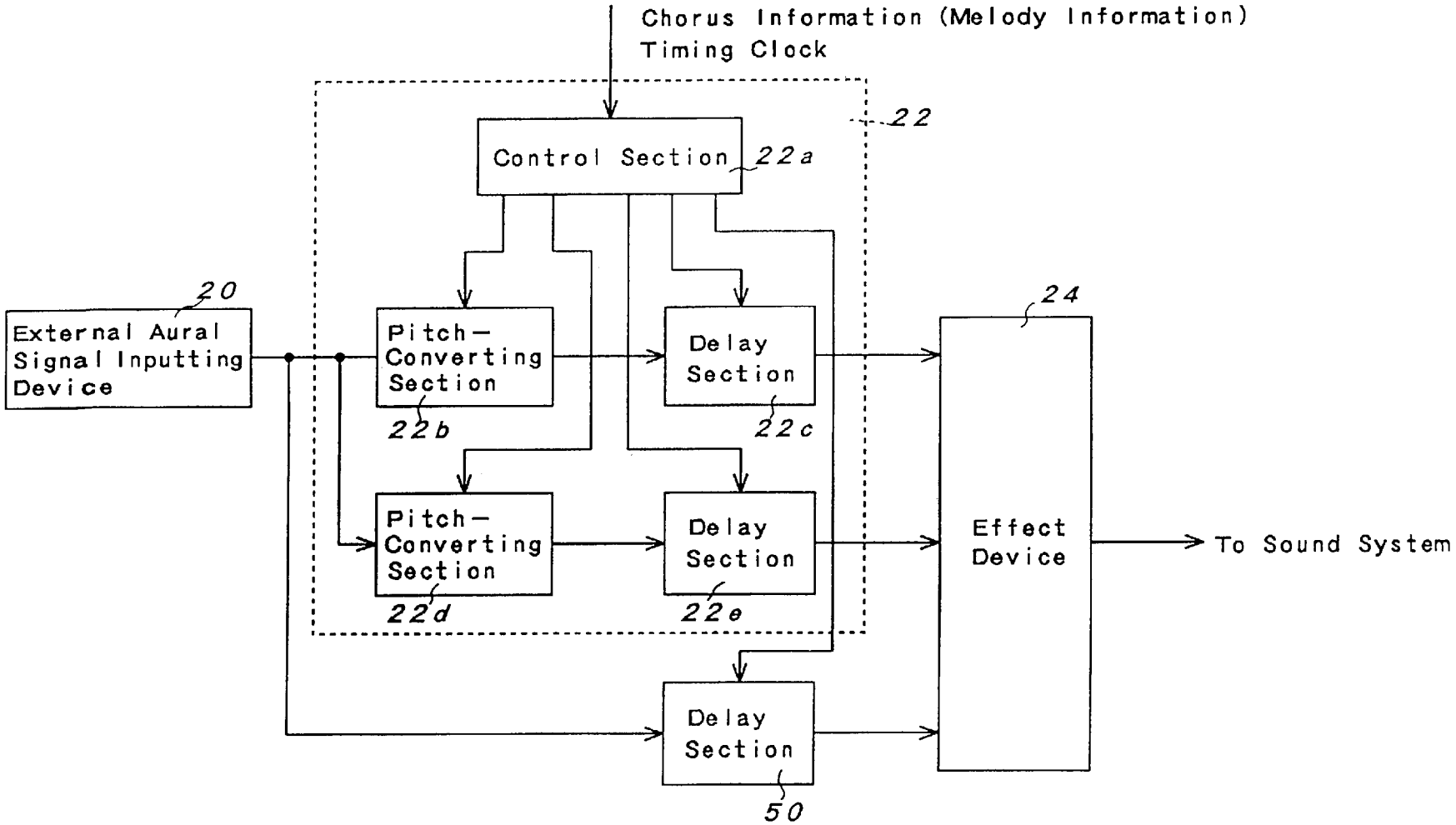
FIG. 7 is a block constitutional diagram showing a constitution of a part which is composed of the external aural signal inputting device, the pitch converter and the effect device in the respective embodiments for realizing three-part chorus.

In the embodiments shown in FIGS. 1, 3, 4 and 6, two-parts chorus being composed of the external aural signals which have been pitch-converted and the external aural signals which have not been pitch-converted is realized. In this connection, however, when, for example, to the constitution of the pitch converter 22 shown in FIG. 6 are added one more line of a pitch-converting section and a delay section as a pitch-converting section 22*d* and a delay section 22*e,* (see FIG. 7) three-parts chorus can be realized. Moreover, it is also possible to realize four- or more-parts chorus in accordance with the same manner as that described above.

Furthermore, in the case where the pitch converter 22 is the one which utilizes a memory as disclosed in the above described Japanese Patent Laid-open No. 174096/1988, a desired delay time can be given when a desired offset region is provided before the memory region which is used for the pitch-converting treatment without providing a separate delay means.

In the use of such delay means, when one-person singing is delayed by every prescribed periods of time, an effect of round as if which is performed by a plurality of singers can easily be realized in spite of solo singing by one person.

Furthermore, a sound volume control means for controlling sound volume is disposed at the latter part of the pitch converter 22 (e.g. the latter part of the delay sections 22*c* and 22*e*) and a path for the external aural signals which have not been pitch-converted (the latter part of the delay section 50 in the case where the delay section 50 has been provided), respectively, whereby sound volume can suitably be controlled by the control section 22*a.* Moreover, in the case where output signals from the sound volume control means are not required, a value of sound volume may be set to "0" in the sound volume control means.

Figure 8:
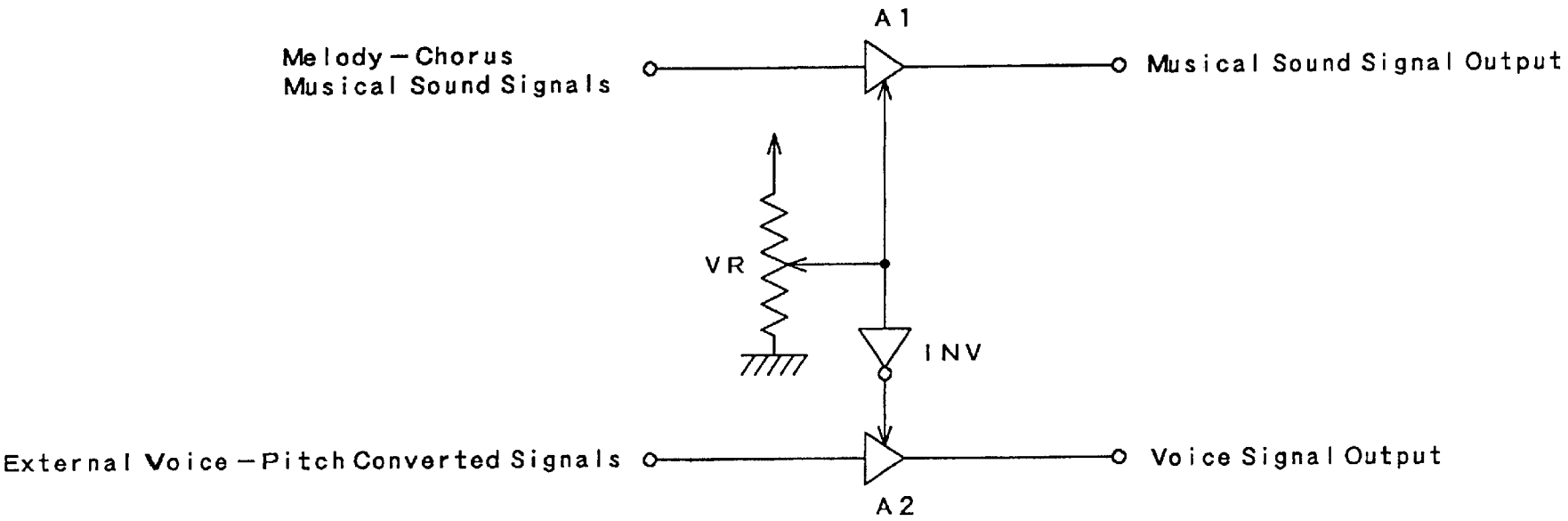
FIG. 8 is a circuit constitutional diagram showing a sound volume balancing circuit between melody musical sound signals as well as chorus musical sound signals and external aural signals as well as pitch-converting signals.

In the above described respective embodiments, while it has been described that sound volume is automatically controlled in a suitable manner in response to the tone color selected in either of the cases of BGM performance and Karaoke performance, a constitution for controlling sound volume as shown in FIG. 8 may be added. More specifically, FIG. 8 shows a sound volume balance circuit between melody musical sound signals as well as chorus musical sound signals and external aural signals as well as pitch-converted signals.

In the case where melody-chorus musical sound signals (signals obtained by mixing the melody musical sound signals with the chorus musical sound signals output from the sound source 18) are used as guide tone, adjustment can be more easily carried out in such a case where both of said melody-chorus musical sound signals and external aural-pitch converted signals (signals obtained by mixing the external aural signals inputted from the external aural signal inputting device 20 with the pitch-converted signals produced by pitch-converting said external aural signals in the pitch converter 22) change inversely proportional to one another, when it is tried to balance both the signals.

More specifically, when a balance of sound volume between guide tone and melody singing is established in the case where melody sound is used as the guide tone, more easy setting can be made by operating one operation button to change inversely proportional to both of the guide tone and melody singing in sound volume levels than the case where the sound volume levels of the guide tone and the melody singing are separately and independently adjusted.

In FIG. 8, reference character VR designates a volume which varies with a value ranging from "0" to "1" wherein to a multiplier A1 is inputted a value of the volume VR without any modification, but to a multiplier A2 is inputted an inverted value of the volume VR through an inverter INV, and thus such a value varying a range of from "1" to "0" is inputted to the multiplier A2. Accordingly, when the volume VR is adjusted, the melody-chorus musical sound signals vary inversely proportional to the external aural-pitch converted signals, so that easy setting and operation of sound volume balance can be carried out.

In the above described respective embodiments, while the effect adding system which utilizes MIDI has been described, it is, of course, not limited to MIDI specification, but the other specification may also be utilized.

Furthermore, as to accompaniment sound, reproduction may be effected in accordance with conventional audio information different from the cases of the above described respective embodiments.

Moreover, such modification that the performance information stored in a storage unit contains words information of a musical composition, and the words are indicated on a display device which is separately disposed in response to performance of the musical composition may be made. Besides, in the indicated words, a color of the words in a chorus part may be made to be different from the other parts to notify a singer that to this part is to be added the chorus part.

Since the present invention has been constituted as described above, the advantages as described hereinbelow are attained.

In the effect adding system according to the present invention comprises an input means for inputting aural signals from the outside; an accompaniment sound producing means for producing accompaniment sounds of a musical composition; a storage means for storing prescribed performance information concerning the musical composition; a pitch conversion information outputting means for outputting the pitch conversion information for pitch conversion based on the prescribed performance information stored in the storage means in synchronous with the accompaniment sounds produced by the accompaniment sound producing means; and a pitch-converting means for converting a pitch of the aural signals inputted from the input means in response to the pitch conversion information output from the pitch conversion information outputting means to output the aural signals of the converted pitch, the aural signals inputted from the outside through the inputting means by singing words of a musical composition are pitch-converted by the pitch-converting means so as to correspond to a pitch of chorus expressed by prescribed performance information of said musical composition, for example, chorus information which expresses the chorus to be added to the melody of said musical composition stored in the storage means based on said chorus information. This pitch-conversion is carried out by outputting pitch-converting information from the pitch conversion information outputting means to the pitch-converting means in synchronous with the accompaniment sounds produced from the accompaniment sound producing means. Accordingly, the aural signals inputted from the inputting means are pitch-converted and output in synchronous with the production of accompaniment sounds of said musical composition by means of the accompaniment sound producing means, so that it becomes to sound voice of different height in sound from that of the aural signals inputted from the inputting means, whereby the same effect as in the case of chorus performance can be obtained.

Therefore, according to the present invention, when one person sings in case of the application of Karaoke performance, singing having a different height in sound from that in the actual singing is automatically performed, so that the same effect as in the case where chorus or the like is performed by plural persons can be realized by even a single person singing.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. An effect adding system comprising:

an input means for inputting an aural signal expressing a melody of a musical composition from the outside;

a storage means for storing predescribed performance information concerning said musical composition including at least accompaniment information for producing an accompaniment sound and chorus information independent of said accompaniment information for prescribing height in sound of a chorus to be added to said melody with different height in sound from height in sound of said melody;

a readout for reading out said performance information stored in said storage means in prescribed timing;

an accompaniment sound producing means for producing said accompaniment sound on the basis of said accompaniment information included in said performance information read out by said readout means;

a pitch conversion information outputting means for outputting pitch conversion information for pitch conversion on the basis of said chorus information included in said performance information read out by said readout means in synchronous with production of said accompaniment sound by said accompaniment sound producing means;

a pitch-converting means for converting a pitch of said aural signal expressing said melody inputted from said input means in response to said pitch conversion information outputted from said pitch conversion information outputting means;

an aural signal outputting means for outputting said aural signal expressing said melody inputted form said input means and said aural signal converted said pitch by said pitch-converting means.

2. An effect adding system comprising:

an input means for inputting an aural signal from the outside;

a storage means for storing prescribed performance information including at least accompaniment information for producing an accompaniment sound of a musical composition and control information indicating commencement and stoppage of delay of said aural signal in a specified portion of said musical composition;

a readout means for reading out said performance information stored in said storage means in prescribed timing;

an accompaniment sound producing means for producing said accompaniment sound on the basis of said accompaniment information included in said performance information read out by said readout means;

a delay means for controlling commencement and stoppage of delay of said aural signal inputted from said input means on the basis of said control information included in said performance information read out by said readout means in synchronous with production of said accompaniment sound by said accompaniment sound producing means, and delaying said aural signal inputted from said input means, and outputting said aural signal to be delayed.

3. An effect adding system comprising:

an input means for inputting an aural signal expressing a melody of a musical composition from the outside;

a storage means for storing prescribed performance information concerning said musical composition including at least accompaniment information for producing an accompaniment sound, chorus information independent of said accompaniment information for prescribing height in sound of a chorus to be added to said melody with different height in sound from height in sound of said melody and control information indicating commencement and stoppage of delay of said aural signal in a specified portion of said musical composition;

a readout means for reading out said performance information stored in said storage means in prescribed timing;

an accompaniment sound producing means for producing said accompaniment sound on the basis of said accompaniment information included in said performance information read out by said readout means;

a pitch conversion information outputting means for outputting pitch conversion information for pitch conversion on the basis of said chorus information included in said performance information read out by said readout means in synchronous with production of said accompaniment sound by said accompaniment sound producing means;

a pitch-converting means for converting a pitch of said aural signal expressing said melody inputted from said input means in response to said pitch conversion information outputted from said pitch conversion information outputting means, and outputting said aural signal converted said pitch;

a delay means for controlling commencement and stoppage of delay of said aural signal converted said pitch outputted from said pitch-converting means on the basis of said control information included in said performance information read out by said readout means in synchronous with production of said accompaniment sound by said accompaniment sound producing means, and delaying said aural signal converted said pitch outputted from said pitch-converting means, and outputting said aural signal converted said pitch to be delayed.

4. An effect adding system as claimed in any one of claims 1 and 3 further comprising:

a guide tone producing means for producing a chorus musical sound as a guide tone on the basis of said chorus information included in said performance information read out by said readout means in synchronous with production of said accompaniment sound by said accompaniment sound producing means.

5. An effect adding system as claimed in any one of claims 1 and 3 further comprising:

a mode selecting means for selecting any one of a normal mode and a melody correction mode, and wherein said storage means further stores melodic information expressing said melody as said performance information, and said pitch conversion information outputting means outputs said pitch conversion information for pitch conversion on the basis of said chorus information included in said performance information read out by said readout means in synchronous with production of said accompaniment sound by said accompaniment sound producing means in the case when said normal mode is selected through said mode selecting means, and said pitch conversion information outputting means outputs said pitch conversion information for pitch conversion on the basis of said melodic information included in said performance information read out by said readout means in the case when said melody correction mode is selected by said mode selecting means.

6. An effect adding system comprising:

an input means for inputting an aural signal expressing a melody of a musical composition from the outside;

a storage means for storing prescribed performance information concerning said musical composition including at least accompaniment information for producing accompaniment sound and melodic information expressing a melody independent of said accompaniment information;

a readout means for reading out said performance information stored in said storage means in prescribed timing;

an accompaniment sound producing means for producing said accompaniment sound on the basis of said accompaniment information included in said performance information read out by said readout means;

a pitch conversion information outputting means for outputting pitch conversion information for pitch conversion on the basis of said melodic information included in said performance information read out by said readout means in synchronous with production of said accompaniment sound by said accompaniment sound producing means;

a pitch-converting means for converting a pitch of said aural signal expressing said melody inputted from said input means in response to said pitch conversion information outputted from said pitch conversion information outputting means, and outputting said aural signal of converted pitch; and a guide tone producing means for producing melodic musical sound as a guide tone on the basis of said melodic information included in said performance information read out by said readout means in synchronous with production of said accompaniment sound by said accompaniment sound producing means.

* * * * *

UNITED STATES PATENT AND TRADEMARK OFFICE

CERTIFICATE OF CORRECTION

PATENT NO. : 5,811,707

DATED : September 22, 1998

INVENTOR(S) : Kakehashi et al.

It is certified that error appears in the above-identified patent and that said Letters Patent is hereby corrected as shown below:

In claim 1 (Col. 16, l. 46), delete "form" and insert therefor -- from --.

Signed and Sealed this

Twenty-seventh Day of April, 1999

*Attest:*

Q. TODD DICKINSON

*Attesting Officer*

*Acting Commissioner of Patents and Trademarks*